US012324557B2

(12) United States Patent
Conrad

(10) Patent No.: US 12,324,557 B2
(45) **Date of Patent: *Jun. 10, 2025**

(54) PORTABLE SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/744,561

(22) Filed: Jun. 14, 2024

(65) Prior Publication Data

US 2024/0389805 A1 Nov. 28, 2024

Related U.S. Application Data

(63) Continuation of application No. 18/345,395, filed on Jun. 30, 2023, now Pat. No. 12,048,409, which is a (Continued)

(30) Foreign Application Priority Data

Aug. 29, 2007 (CA) ..... CA 2599303
Mar. 13, 2009 (CA) ..... CA 2658372

(51) Int. Cl.
*A47L 9/16* (2006.01)
*A47L 5/22* (2006.01)

(Continued)

(52) U.S. Cl.
CPC ..... *A47L 5/24* (2013.01); *A47L 5/225* (2013.01); *A47L 5/28* (2013.01); *A47L 5/32* (2013.01);

(Continued)

(58) Field of Classification Search
CPC ..... A47L 5/24; A47L 5/28; A47L 5/32; A47L 9/16

See application file for complete search history.

(56) References Cited

U.S. PATENT DOCUMENTS 2,036,694 A 4/1936 Hansson
2,071,975 A 2/1937 Holm-Hansen et al.

(Continued)

FOREIGN PATENT DOCUMENTS

CA 1218962 3/1987
CA 2086374 C 11/1996

(Continued)

OTHER PUBLICATIONS

English machine translation of DE202005020767U1, published on Aug. 10, 2006.

(Continued)

*Primary Examiner* — Michael D Jennings
(74) *Attorney, Agent, or Firm* — Philip C. Mendes Da Costa; SMART & BIGGAR LP

(57) ABSTRACT

A hand vacuum cleaner has a housing comprising a first portion that houses a suction motor. A cyclone unit is positioned in an air flow passage upstream from the suction motor. The cyclone unit comprises a cyclone and a dirt collection region that is positioned forward of the cyclone. The cyclone unit front end has an openable door. The cyclone air outlet comprises an assembly which includes a screen. The assembly is moveable relative to the cyclone unit sidewall in a common direction with the cyclone axis of rotation whereby the assembly and the sidewall are separable from each other in a forward direction.

20 Claims, 10 Drawing Sheets

Related U.S. Application Data continuation of application No. 17/367,538, filed on Jul. 5, 2021, now Pat. No. 11,751,733, which is a continuation of application No. 17/196,380, filed on Mar. 9, 2021, now Pat. No. 11,622,659, which is a continuation of application No. 15/931,973, filed on May 14, 2020, now Pat. No. 11,529,031, which is a continuation of application No. 16/022,902, filed on Jun. 29, 2018, now Pat. No. 11,330,944, which is a continuation of application No. 15/012,783, filed on Feb. 1, 2016, now Pat. No. 10,548,442, which is a continuation of application No. 14/874,544, filed on Oct. 5, 2015, now Pat. No. 9,826,868, which is a continuation of application No. 13/255,875, filed as application No. PCT/CA2010/000342 on Mar. 9, 2010, now Pat. No. 9,204,769, said application No. 18/345,395 is a continuation-in-part of application No. 16/549,189, filed on Aug. 23, 2019, now Pat. No. 11,700,983, which is a continuation of application No. 16/022,845, filed on Jun. 29, 2018, now Pat. No. 10,433,686, which is a continuation of application No. 15/406,434, filed on Jan. 13, 2017, now Pat. No. 10,561,286, which is a continuation of application No. 14/470,342, filed on Aug. 27, 2014, now abandoned, which is a continuation of application No. 12/721,128, filed on Mar. 10, 2010, now Pat. No. 8,950,039, which is a continuation-in-part of application No. 12/675,512, filed as application No. PCT/CA2008/001531 on Aug. 28, 2008, now abandoned, and a continuation-in-part of application No. 12/675,540, filed as application No. PCT/CA2008/001530 on Aug. 28, 2008, now Pat. No. 9,027,201, said application No. 12/721,128 is a continuation-in-part of application No. 12/675,636, filed as application No. PCT/CA2008/001519 on Aug. 27, 2008, now abandoned.

(51) Int. Cl.

| | |
|---|---|
| ***A47L 5/24*** | (2006.01) |
| ***A47L 5/28*** | (2006.01) |
| ***A47L 5/32*** | (2006.01) |
| ***A47L 9/02*** | (2006.01) |
| ***A47L 9/10*** | (2006.01) |
| ***A47L 9/32*** | (2006.01) |

(52) U.S. Cl.

CPC ..... *A47L 9/02* (2013.01); *A47L 9/106* (2013.01); *A47L 9/1608* (2013.01); *A47L 9/1666* (2013.01); *A47L 9/1683* (2013.01); *A47L 9/1691* (2013.01); *A47L 9/322* (2013.01)

(56) References Cited

U.S. PATENT DOCUMENTS

| | | | |
|---|---|---|---|
| 2,533,057 | A | 12/1950 | Senne |
| 2,542,634 | A | 2/1951 | Davis et al. |
| 2,559,384 | A | 7/1951 | Anderson, Jr. |
| 2,621,756 | A | 12/1952 | Senne |
| 2,632,524 | A | 3/1953 | Senne |
| 2,913,111 | A | 11/1959 | Rogers |
| 2,942,691 | A | 6/1960 | Dillon |
| 3,015,122 | A | 1/1962 | Cook |
| 3,130,157 | A | 4/1964 | Kelsall et al. |
| 3,200,568 | A | 8/1965 | McNeil |
| 3,310,828 | A | 3/1967 | Clark et al. |
| 3,320,727 | A | 5/1967 | Farley et al. |
| 3,356,334 | A | 12/1967 | Scaramucci |
| 3,457,744 | A | 7/1969 | Bisbing |
| 3,530,649 | A | 9/1970 | Porsch et al. |
| 3,582,616 | A | 6/1971 | Wrob |
| 3,822,533 | A | 7/1974 | Oranje |
| 3,898,068 | A | 8/1975 | McNeil |
| 3,988,132 | A | 10/1976 | Oranje |
| 3,988,133 | A | 10/1976 | Schady |
| 4,187,088 | A | 2/1980 | Hodgson |
| 4,236,903 | A | 12/1980 | Malmsten |
| 4,373,228 | A | 2/1983 | Dyson |
| 4,393,536 | A | 7/1983 | Tapp |
| 4,443,910 | A | 4/1984 | Fitzwater |
| 4,573,236 | A | 3/1986 | Dyson |
| 4,635,315 | A | 1/1987 | Kozak |
| 4,826,515 | A | 5/1989 | Dyson |
| 4,831,685 | A | 5/1989 | Bosyj et al. |
| 4,836,515 | A | 6/1989 | Franz et al. |
| 4,905,342 | A | 3/1990 | Ataka |
| 5,054,157 | A | 10/1991 | Werner et al. |
| 5,078,761 | A | 1/1992 | Dyson |
| 5,129,125 | A | 7/1992 | Gamou et al. |
| 5,230,722 | A | 7/1993 | Yonkers |
| 5,267,371 | A | 12/1993 | Soler et al. |
| 5,287,591 | A | 2/1994 | Rench et al. |
| 5,309,600 | A | 5/1994 | Weaver et al. |
| 5,309,601 | A | 5/1994 | Hampton et al. |
| 5,358,290 | A | 10/1994 | Fleet et al. |
| 5,524,321 | A | 6/1996 | Weaver et al. |
| 5,715,566 | A | 2/1998 | Weaver et al. |
| 5,836,047 | A | 11/1998 | Lee et al. |
| 5,842,254 | A | 12/1998 | Lee |
| 5,858,038 | A | 1/1999 | Dyson et al. |
| 5,974,625 | A | 11/1999 | Garner |
| 6,058,559 | A | 5/2000 | Yoshimi et al. |
| 6,070,291 | A | 6/2000 | Bair et al. |
| 6,081,961 | A | 7/2000 | Wang |
| 6,098,244 | A | 8/2000 | Conrad et al. |
| 6,099,661 | A | 8/2000 | Conrad |
| 6,101,672 | A | 8/2000 | Conrad et al. |
| 6,123,779 | A | 9/2000 | Conrad et al. |
| 6,129,775 | A | 10/2000 | Conrad et al. |
| 6,135,708 | A | 10/2000 | Conrad et al. |
| 6,168,716 | B1 | 1/2001 | Conrad et al. |
| 6,170,119 | B1 | 1/2001 | Conrad et al. |
| 6,173,474 | B1 | 1/2001 | Conrad |
| 6,174,127 | B1 | 1/2001 | Conrad et al. |
| 6,183,641 | B1 | 2/2001 | Conrad et al. |
| 6,210,469 | B1 | 4/2001 | Tokar |
| 6,221,134 | B1 | 4/2001 | Conrad et al. |
| 6,224,325 | B1 | 5/2001 | Conrad et al. |
| 6,228,260 | B1 | 5/2001 | Conrad et al. |
| 6,231,645 | B1 | 5/2001 | Conrad et al. |
| 6,238,177 | B1 | 5/2001 | Conrad et al. |
| 6,243,917 | B1 | 6/2001 | Conrad |
| 6,251,296 | B1 | 6/2001 | Conrad et al. |
| 6,256,832 | B1 | 7/2001 | Dyson |
| 6,261,052 | B1 | 7/2001 | Conrad et al. |
| 6,261,379 | B1 | 7/2001 | Conrad et al. |
| 6,280,143 | B1 | 8/2001 | Parker et al. |
| 6,295,692 | B1 | 10/2001 | Shideler |
| 6,307,358 | B1 | 10/2001 | Conrad |
| 6,312,594 | B1 | 11/2001 | Conrad et al. |
| 6,328,527 | B1 | 12/2001 | Conrad et al. |
| 6,334,234 | B1 | 1/2002 | Conrad et al. |
| 6,344,064 | B1 | 2/2002 | Conrad |
| 6,406,505 | B1 | 6/2002 | Oh et al. |
| 6,434,785 | B1 | 8/2002 | Vandenbelt et al. |
| 6,440,197 | B1 | 8/2002 | Conrad et al. |
| 6,457,205 | B1 | 10/2002 | Conrad |
| 6,463,622 | B2 | 10/2002 | Wright et al. |
| 6,482,252 | B1 | 11/2002 | Conrad et al. |
| 6,502,278 | B2 | 1/2003 | Oh et al. |
| 6,533,834 | B2 | 3/2003 | Conrad et al. |
| 6,553,612 | B1 | 4/2003 | Dyson et al. |
| 6,560,818 | B1 | 5/2003 | Hasko |
| 6,581,239 | B1 | 6/2003 | Dyson et al. |
| 6,596,046 | B2 | 7/2003 | Conrad et al. |
| 6,599,338 | B2 | 7/2003 | Oh et al. |
| 6,599,340 | B2 | 7/2003 | Conrad et al. |
| 6,623,539 | B2 | 9/2003 | Lee et al. |

(56) References Cited

U.S. PATENT DOCUMENTS 6,736,873 B2 5/2004 Conrad et al.
6,746,500 B1 6/2004 Park et al.
6,766,558 B1 7/2004 Matsumoto et al.
6,782,583 B2 8/2004 Oh
6,782,585 B1 8/2004 Conrad et al.
6,833,015 B2 12/2004 Oh et al.
6,848,146 B2 2/2005 Wright et al.
6,874,197 B1 4/2005 Conrad et al.
6,902,596 B2 6/2005 Conrad et al.
7,131,165 B2 11/2006 Wright et al.
7,146,681 B2 12/2006 Wright et al.
7,160,346 B2 1/2007 Park
7,222,303 B2 5/2007 Oren et al.
7,222,393 B2 5/2007 Kaffenberger et al.
7,247,181 B2 7/2007 Hansen et al.
7,278,181 B2 10/2007 Harris et al.
7,329,294 B2 2/2008 Conrad
7,335,242 B2 2/2008 Oh
7,370,387 B2 5/2008 Walker et al.
7,377,008 B2 5/2008 Park et al.
7,381,234 B2 6/2008 Oh
7,386,916 B2 6/2008 Bone
7,448,363 B1 11/2008 Rasmussen et al.
7,485,164 B2 2/2009 Jeong et al.
7,488,362 B2 2/2009 Jeong et al.
7,540,894 B2 6/2009 Ni
7,547,338 B2 6/2009 Kim et al.
7,581,286 B2 9/2009 Choi
7,584,522 B1 9/2009 Weeter et al.
7,594,296 B2 9/2009 Park
7,597,730 B2 10/2009 Yoo et al.
7,604,675 B2 10/2009 Makarov et al.
7,624,475 B2 12/2009 Choi
7,645,311 B2 1/2010 Oh et al.
7,686,858 B2 3/2010 Oh
7,740,675 B2 6/2010 Conrad
7,740,676 B2 6/2010 Burnham et al.
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,882,592 B2 2/2011 Hwang et al.
7,887,612 B2 2/2011 Conrad
7,922,794 B2 4/2011 Morphey
7,941,895 B2 5/2011 Conrad
7,979,953 B2 7/2011 Yoo
8,015,659 B2 9/2011 Conrad et al.
8,032,981 B2 10/2011 Yoo
8,032,983 B2 10/2011 Griffith et al.
8,100,999 B2 1/2012 Ashbee et al.
8,127,398 B2 3/2012 Conrad
8,146,201 B2 4/2012 Conrad
8,151,407 B2 4/2012 Conrad
8,166,607 B2 5/2012 Conrad
8,176,596 B2 5/2012 Conrad
8,191,203 B2 6/2012 Yoo
8,192,515 B2 6/2012 Conrad
8,292,979 B2 10/2012 Conrad
8,347,455 B2 1/2013 Dyson et al.
8,349,428 B2 1/2013 Conrad
8,359,705 B2 1/2013 Conrad
8,444,731 B2 5/2013 Gomiciaga-Pereda et al.
8,448,291 B2 5/2013 Conrad
8,468,646 B2 6/2013 Yoo
8,484,799 B2 7/2013 Conrad
8,510,907 B2 8/2013 Conrad
8,528,160 B2 9/2013 Conrad
8,561,257 B2 10/2013 Conrad
8,590,102 B2 11/2013 Conrad
8,607,407 B2 12/2013 Conrad
8,621,709 B2 1/2014 Conrad
8,677,558 B2 3/2014 Conrad
8,713,751 B2 5/2014 Conrad
8,769,767 B2 7/2014 Conrad
8,869,344 B2 10/2014 Conrad
8,950,039 B2 * 2/2015 Conrad ..... A47L 9/1641 15/327.2
9,119,513 B2 9/2015 Conrad
9,591,952 B2 3/2017 Conrad
9,826,868 B2 * 11/2017 Conrad ..... A47L 9/106
10,016,106 B1 7/2018 Conrad
10,092,146 B2 10/2018 Conrad
10,117,551 B2 11/2018 Horvath et al.
10,149,587 B2 12/2018 Conrad et al.
10,156,083 B2 12/2018 Ortiz et al.
10,159,391 B2 12/2018 Brown et al.
10,165,912 B2 1/2019 Conrad
10,251,521 B2 4/2019 Conrad et al.
10,253,517 B2 4/2019 Hayes et al.
10,258,210 B2 4/2019 Conrad
10,271,704 B2 4/2019 Conrad
10,299,643 B2 5/2019 Conrad
10,327,610 B2 6/2019 Brown et al.
10,405,708 B2 9/2019 Dimbylow
10,405,709 B2 9/2019 Conrad
10,426,302 B2 10/2019 Brown et al.
10,433,687 B2 10/2019 Dimbylow
10,470,624 B2 11/2019 Dimbylow
10,506,904 B2 12/2019 Conrad et al.
10,537,216 B2 1/2020 Conrad
10,537,219 B2 1/2020 Conrad et al.
10,557,278 B2 2/2020 Hayes et al.
10,631,693 B2 4/2020 Conrad
10,631,697 B2 4/2020 Henderson
10,702,113 B2 7/2020 Conrad
10,716,444 B2 7/2020 Khalil et al.
10,722,086 B2 7/2020 Conrad
10,736,475 B2 8/2020 Paulla et al.
10,750,913 B2 8/2020 Conrad
10,765,278 B2 9/2020 Conrad et al.
10,767,382 B2 9/2020 Hayes et al.
10,786,126 B2 9/2020 Paulla et al.
10,827,891 B2 11/2020 Conrad
10,828,649 B2 11/2020 Conrad
10,842,330 B2 11/2020 Conrad
10,919,051 B2 2/2021 Conrad
10,925,451 B2 2/2021 Conrad
10,959,586 B2 3/2021 Conrad et al.
10,966,582 B2 4/2021 Conrad et al.
10,966,583 B2 4/2021 Conrad
10,974,258 B2 4/2021 Conrad
10,980,379 B2 4/2021 Horvath et al.
11,026,550 B2 6/2021 Conrad
11,059,054 B2 7/2021 Conrad
11,129,510 B2 9/2021 Conrad
11,135,602 B2 10/2021 Conrad
11,213,832 B2 1/2022 Conrad
11,219,906 B2 1/2022 Conrad
11,229,334 B2 1/2022 Conrad et al.
11,229,341 B2 1/2022 Bradley
11,235,339 B2 2/2022 Conrad
11,236,523 B2 2/2022 Hayes et al.
11,246,462 B2 2/2022 Conrad
11,285,495 B2 3/2022 Conrad
11,331,680 B2 5/2022 Conrad
11,357,370 B2 6/2022 Bohlen et al.
11,412,904 B2 8/2022 Henderson
11,432,690 B2 9/2022 Paulla et al.
11,445,873 B2 9/2022 Conrad et al.
11,445,874 B2 9/2022 Conrad et al.
11,445,875 B2 9/2022 Conrad
11,524,306 B2 12/2022 Conrad
11,602,758 B2 3/2023 Conrad et al.
11,642,681 B2 5/2023 Conrad
11,653,800 B2 5/2023 Horvath et al.
11,673,148 B2 6/2023 Conrad
11,737,621 B2 8/2023 Conrad
11,759,066 B2 9/2023 Conrad et al.
11,786,918 B2 10/2023 Conrad
11,793,374 B2 10/2023 Conrad
11,819,178 B2 11/2023 Conrad
11,826,007 B2 11/2023 Conrad et al.
11,849,906 B2 12/2023 Bradley

(56) References Cited

U.S. PATENT DOCUMENTS 11,857,142 B2 1/2024 Conrad
11,889,969 B2 2/2024 Conrad
11,896,185 B2 2/2024 Conrad
11,896,186 B1 2/2024 Conrad
11,903,547 B1 2/2024 Conrad
11,903,548 B2 2/2024 Conrad
11,918,168 B2 3/2024 Conrad
11,938,491 B2 3/2024 Conrad
11,950,745 B2 4/2024 Conrad et al.
11,992,167 B2 5/2024 Conrad
11,992,848 B2 5/2024 Conrad
12,023,690 B2 7/2024 Conrad
12,029,375 B2 7/2024 Tonderys et al.
12,035,872 B2 7/2024 Paulla et al.
12,048,409 B2 * 7/2024 Conrad ..... A47L 9/02
12,064,775 B2 8/2024 Conrad
12,065,854 B2 8/2024 Hayes et al.
12,082,759 B2 9/2024 Conrad et al.
2001/0023517 A1 9/2001 Onishi et al.
2001/0027587 A1 10/2001 Conrad et al.
2002/0011053 A1 1/2002 Oh
2002/0062531 A1 5/2002 Oh
2002/0112315 A1 8/2002 Conrad
2002/0134059 A1 9/2002 Oh
2002/0134238 A1 9/2002 Conrad et al.
2002/0162188 A1 11/2002 Harmen
2002/0178535 A1 12/2002 Oh et al.
2002/0178698 A1 12/2002 Oh et al.
2002/0178699 A1 12/2002 Oh
2003/0028994 A1 2/2003 Kitamura et al.
2003/0037403 A1 2/2003 Lang
2003/0046910 A1 3/2003 Lee et al.
2003/0066273 A1 4/2003 Choi et al.
2003/0158238 A1 8/2003 Hale et al.
2003/0159411 A1 8/2003 Hansen et al.
2003/0201754 A1 10/2003 Conrad
2004/0010885 A1 1/2004 Hitzelberger et al.
2004/0020005 A1 2/2004 Odachi et al.
2004/0025285 A1 2/2004 McCormick et al.
2004/0078921 A1 4/2004 Yuasa et al.
2004/0112022 A1 6/2004 Vuijk
2004/0163201 A1 8/2004 Murphy et al.
2004/0194249 A1 10/2004 Lee et al.
2004/0194251 A1 10/2004 Overvaag et al.
2004/0216263 A1 11/2004 Best et al.
2004/0216264 A1 11/2004 Shaver et al.
2004/0216266 A1 11/2004 Conrad
2005/0138757 A1 6/2005 Lee
2005/0144754 A1 7/2005 Ivarsson et al.
2005/0198769 A1 9/2005 Lee et al.
2005/0252179 A1 11/2005 Oh et al.
2006/0005346 A1 1/2006 Rupp et al.
2006/0037172 A1 2/2006 Choi
2006/0042038 A1 3/2006 Arnold et al.
2006/0042206 A1 3/2006 Arnold et al.
2006/0075598 A1 4/2006 Follegot et al.
2006/0080947 A1 4/2006 Lee et al.
2006/0090290 A1 5/2006 Lau
2006/0123590 A1 6/2006 Fester et al.
2006/0130448 A1 6/2006 Han et al.
2006/0137304 A1 6/2006 Jeong et al.
2006/0137305 A1 6/2006 Jung
2006/0137306 A1 6/2006 Jeong et al.
2006/0137309 A1 6/2006 Jeong et al.
2006/0137314 A1 6/2006 Conrad et al.
2006/0156699 A1 7/2006 Kim
2006/0162298 A1 7/2006 Oh et al.
2006/0162299 A1 7/2006 North
2006/0168922 A1 8/2006 Oh
2006/0168923 A1 8/2006 Lee et al.
2006/0196004 A1 9/2006 Conrad
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0230726 A1 10/2006 Oh et al.
2006/0236663 A1 10/2006 Oh
2006/0278081 A1 12/2006 Han et al.
2007/0012002 A1 1/2007 Oh et al.
2007/0012003 A1 1/2007 Oh et al.
2007/0039120 A1 2/2007 Choi
2007/0067944 A1 3/2007 Kitamura et al.
2007/0079473 A1 4/2007 Min et al.
2007/0079584 A1 4/2007 Kim et al.
2007/0079585 A1 4/2007 Oh et al.
2007/0079587 A1 4/2007 Kim
2007/0084161 A1 4/2007 Yoo
2007/0095028 A1 5/2007 Kim et al.
2007/0095029 A1 5/2007 Min et al.
2007/0095030 A1 5/2007 Oh
2007/0226947 A1 10/2007 Kang
2007/0251048 A1 11/2007 Choi
2007/0271724 A1 11/2007 Hakan et al.
2007/0289085 A1 12/2007 Yoo
2007/0289089 A1 12/2007 Yacobi
2007/0289264 A1 12/2007 Oh
2008/0040883 A1 2/2008 Beskow et al.
2008/0047091 A1 2/2008 Nguyen
2008/0052872 A1 3/2008 Cho
2008/0083085 A1 4/2008 Genn
2008/0134460 A1 6/2008 Conrad
2008/0134462 A1 6/2008 Jansen et al.
2008/0172821 A1 7/2008 Kang et al.
2008/0172992 A1 7/2008 Conrad
2008/0172995 A1 7/2008 Conrad
2008/0178416 A1 7/2008 Conrad
2008/0178418 A1 7/2008 Conrad
2008/0178420 A1 7/2008 Conrad
2008/0179133 A1 7/2008 Conrad
2008/0184893 A1 8/2008 Oh et al.
2008/0190080 A1 8/2008 Oh et al.
2008/0196195 A1 8/2008 Conrad
2008/0196196 A1 8/2008 Conrad
2008/0196366 A1 8/2008 Conrad
2008/0209666 A1 9/2008 Conrad
2008/0216281 A1 9/2008 Conrad
2009/0031522 A1 2/2009 Yoo et al.
2009/0044371 A1 2/2009 Yoo et al.
2009/0113659 A1 5/2009 Jeon et al.
2009/0144929 A1 6/2009 Yoo
2009/0144932 A1 6/2009 Yoo
2009/0241284 A1 10/2009 Mayes et al.
2009/0282639 A1 11/2009 Dyson et al.
2009/0307864 A1 12/2009 Dyson
2010/0005611 A1 1/2010 Hong et al.
2010/0043170 A1 2/2010 Ni
2010/0045215 A1 2/2010 Hawker et al.
2010/0071153 A1 3/2010 Genn
2010/0083459 A1 * 4/2010 Beskow ..... A47L 9/0081 15/353
2010/0095476 A1 4/2010 Kim et al.
2010/0162515 A1 7/2010 Stephens
2010/0175217 A1 7/2010 Conrad
2010/0175219 A1 7/2010 Soen et al.
2010/0229322 A1 9/2010 Conrad
2010/0229323 A1 9/2010 Conrad
2010/0229325 A1 9/2010 Conrad
2010/0229326 A1 9/2010 Conrad
2010/0229336 A1 9/2010 Conrad
2010/0229338 A1 9/2010 Conrad
2010/0242222 A1 9/2010 Conrad
2010/0251507 A1 10/2010 Conrad
2010/0293745 A1 11/2010 Coburn
2011/0023262 A1 2/2011 Conrad
2011/0219573 A1 9/2011 Conrad
2011/0314629 A1 12/2011 Conrad
2012/0000030 A1 1/2012 Conrad
2012/0159734 A1 6/2012 Fujiwara
2012/0222239 A1 9/2012 Conrad
2012/0222245 A1 9/2012 Conrad
2012/0272472 A1 11/2012 Conrad

(56) References Cited

U.S. PATENT DOCUMENTS

| | | | |
|---|---|---|---|
| 2013/0104335 | A1 | 5/2013 | Conrad |
| 2014/0237768 | A1 | 8/2014 | Conrad |
| 2016/0367094 | A1 | 12/2016 | Conrad |

FOREIGN PATENT DOCUMENTS

| | | | |
|---|---|---|---|
| CA | 2275675 | A1 | 12/1999 |
| CA | 2288544 | A1 | 5/2000 |
| CA | 2289060 | A1 | 5/2000 |
| CA | 2258392 | A1 | 7/2000 |
| CA | 2258416 | A1 | 7/2000 |
| CA | 2258419 | A1 | 7/2000 |
| CA | 2258421 | A1 | 7/2000 |
| CA | 2258422 | A1 | 7/2000 |
| CA | 2258423 | A1 | 7/2000 |
| CA | 2258426 | A1 | 7/2000 |
| CA | 2258428 | A1 | 7/2000 |
| CA | 2330801 | A1 | 7/2001 |
| CA | 2412881 | A1 | 12/2001 |
| CA | 2338193 | A1 | 7/2002 |
| CA | 2339514 | A1 | 9/2002 |
| CA | 2342673 | A1 | 9/2002 |
| CA | 2342993 | A1 | 9/2002 |
| CA | 2241644 | | 12/2007 |
| CA | 2675723 | | 6/2008 |
| CA | 2658005 | | 9/2010 |
| CA | 2658014 | | 9/2010 |
| CA | 2658014 | A1 | 9/2010 |
| CA | 2658022 | A1 | 9/2010 |
| CA | 2658381 | | 9/2010 |
| CA | 2658651 | | 9/2010 |
| CA | 2659212 | | 9/2010 |
| CA | 2674056 | | 9/2010 |
| CA | 2674761 | | 9/2010 |
| CA | 2678119 | | 9/2010 |
| CA | 2755305 | | 9/2010 |
| CA | 2755307 | | 9/2010 |
| CA | 2730689 | | 9/2011 |
| CA | 2574291 | | 8/2013 |
| CA | 2677530 | | 1/2014 |
| CA | 2677530 | C | 1/2014 |
| CN | 2524655 | | 12/2002 |
| CN | 2534954 | | 2/2003 |
| CN | 1626025 | | 10/2005 |
| CN | 1765283 | A | 5/2006 |
| CN | 1806741 | A | 7/2006 |
| CN | 1895148 | | 1/2007 |
| CN | 1911151 | A | 2/2007 |
| CN | 100998484 | A | 7/2007 |
| CN | 101015436 | A | 8/2007 |
| CN | 101061932 | A | 10/2007 |
| CN | 101095604 | A | 1/2008 |
| CN | 201101488 | Y | 8/2008 |
| CN | 101288572 | A | 10/2008 |
| CN | 101357051 | A | 2/2009 |
| CN | 101448447 | A | 6/2009 |
| CN | 101489455 | A | 7/2009 |
| CN | 101489457 | A | 7/2009 |
| CN | 101489461 | A | 7/2009 |
| CN | 201523596 | U | 7/2010 |
| CN | 101822506 | U | 9/2010 |
| CN | 201683850 | U | 12/2010 |
| CN | 102256523 | A | 11/2011 |
| CN | 202173358 | U | 3/2012 |
| CN | 101631494 | | 4/2012 |
| CN | 202699035 | | 1/2013 |
| CN | 103040412 | A | 4/2013 |
| CN | 103040413 | A | 4/2013 |
| CN | 103169420 | A | 6/2013 |
| CN | 203724037 | U | 7/2014 |
| DE | 3734355 | C2 | 6/1989 |
| DE | 3743083 | C2 | 8/1997 |
| DE | 10110581 | C2 | 11/2003 |
| DE | 69907201 | T2 | 2/2004 |
| DE | 60012203 | T2 | 8/2005 |
| DE | 60105004 | T2 | 8/2005 |
| DE | 60201666 | T2 | 6/2006 |
| DE | 202005020767 | U1 | 8/2006 |
| DE | 202006017010 | U1 | 2/2007 |
| DE | 60211663 | T2 | 5/2007 |
| DE | 102007011457 | A1 | 10/2007 |
| DE | 112006003479 | T5 | 12/2008 |
| DE | 112007001314 | T5 | 4/2009 |
| DE | 112007003039 | T5 | 10/2009 |
| DE | 112007003052 | T5 | 1/2010 |
| DE | 112010001135 | T5 | 8/2012 |
| DE | 202012101457 | U1 | 9/2012 |
| DE | 112011104642 | T5 | 10/2013 |
| DE | 102012211246 | A1 | 1/2014 |
| EP | 0489468 | | 6/1992 |
| EP | 489468 | A1 | 6/1992 |
| EP | 0887040 | | 12/1998 |
| EP | 1356755 | A2 | 10/2003 |
| EP | 1674009 | A2 | 6/2006 |
| EP | 1938736 | A2 | 7/2008 |
| EP | 1771104 | B1 | 9/2008 |
| EP | 966912 | | 3/2010 |
| EP | 2049000 | B1 | 6/2011 |
| EP | 1356755 | B1 | 5/2012 |
| EP | 2201875 | | 4/2013 |
| EP | 1629758 | B1 | 10/2013 |
| FR | 2812531 | B1 | 11/2004 |
| GB | 2035787 | B | 10/1982 |
| GB | 2163703 | A | 3/1986 |
| GB | 2163703 | B | 1/1988 |
| GB | 2251178 | A | 7/1992 |
| GB | 2268875 | A | 1/1994 |
| GB | 2365324 | B | 7/2002 |
| GB | 2458243 | B | 4/2012 |
| JP | 2004121722 | A | 4/2004 |
| JP | 2000140533 | | 2/2005 |
| JP | 2005040246 | | 2/2005 |
| JP | 2005087508 | | 4/2005 |
| JP | 2005211350 | A | 8/2005 |
| JP | 2009261501 | A | 11/2009 |
| JP | 2010081968 | A | 4/2010 |
| JP | 2010227287 | | 10/2010 |
| KR | 1020040088978 | A | 10/2004 |
| WO | 9619294 | A1 | 6/1996 |
| WO | 0010718 | A1 | 3/2000 |
| WO | 0078546 | A1 | 12/2000 |
| WO | 2004069021 | A1 | 8/2004 |
| WO | 2005089618 | A1 | 2/2006 |
| WO | 2006026414 | A2 | 3/2006 |
| WO | 2007084699 | A1 | 7/2007 |
| WO | 2007104138 | A1 | 9/2007 |
| WO | 2008009883 | | 1/2008 |
| WO | 2008009888 | | 1/2008 |
| WO | 2008009890 | | 1/2008 |
| WO | 2008017802 | | 2/2008 |
| WO | 2008070966 | | 6/2008 |
| WO | 2008070980 | | 6/2008 |
| WO | 2008135708 | A1 | 11/2008 |
| WO | 2009026709 | | 3/2009 |
| WO | 2010102396 | A1 | 9/2010 |
| WO | 2010102410 | A1 | 9/2010 |
| WO | 2010102411 | A1 | 9/2010 |

OTHER PUBLICATIONS

English machine translaton of DE112010001135T5, Aug. 2, 2012.
English machine translation of DE112007003052T5, published on Jan. 14, 2010.
English machine translation of DE112007003039T5, published on Oct. 29, 2009.
English machine translation of CN203724037u, published on Jul. 23, 2014.
English machine translation of CN202173358U, published on Mach 28, 2012.
English machine translation of CN201683850U, published on Dec. 29, 2010.
English machine translation of CN201523596U, published on Jul. 14, 2010.

(56) References Cited

OTHER PUBLICATIONS

English machine translation of CN103169420A, published on Jun. 26, 2013.
English machine translation of CN103040413A, published on Apr. 17, 2013.
English machine translation of CN103040412A, published on Apr. 17, 2013.
English machine translation of CN102256523A, published on Nov. 23, 2011.
English machine translation of CN101489461A, published on Jul. 22, 2009.
English machine translation of CN101489457A, published on Jul. 22, 2009.
English machine translation of CN101489455A, published on Jul. 22, 2009.
English machine translation of DE3743083C2, published on Aug. 7, 1997.
English machine translation of FR2812531B1, published on Nov. 5, 2004.
English machine translation of CN1911151A, published on Feb. 14, 2007.
English machine translation of KR1020040088978, published on Oct. 20, 2004.
English machine translation of DE10110581, published on Nov. 13, 2003.
English machine translation of CN1626025, published on Oct. 15, 2005.
English machine translation of CN1895148, published on Jan. 17, 2007.
English machine translation of CN100998484, published on Jul. 18, 2007.
English machine translation of CN101015436, published on Aug. 15, 2007.
English machine translation of CN101061932, published on Oct. 31, 2007.
English machine translation of CN101095604, published on Jan. 2, 2008.
English machine translation of CN101288572, published on Oct. 22, 2008.
English machine translation of CN101448447, published on Jun. 3, 2009.
English machine translation of CN101822506, published on Sep. 8, 2010.
English machine translation of CN201683850, published on Dec. 29, 2010.
English machine translation of CN203724037, published on Jul. 23, 2014.
English machine translation of CN101357051, published on Feb. 4, 2009.
English machine translation of CN101631494, published on Apr. 25, 2012.
English machine translation of CN1765283, published on May 3, 2006.
English machine translation of CN1806741, published on Aug. 18, 2005.
English machine translation of CN201101488, published on Aug. 20, 2008.
English machine translation of CN202699035, published on Jan. 30, 2013.
English machine translation of CN2524655, published on Dec. 11, 2002.
English machine translation of CN2534954, published on Feb. 12, 2003.
English machine translation of DE60012203, published on Aug. 18, 2005.
English machine translation of DE60105004, published on Aug. 16, 2005.
English machine translation of DE60201666, published on Jun. 1, 2006.
English machine translation of DE60211663, published on May 10, 2007.
English machine translation of DE69907201, published on Feb. 5, 2004.
English machine translation of DE102007011457, published on Oct. 25, 2007.
English machine translation of DE102012211246, published on Jan. 2, 2014.
English machine translation of DE112006003479, published on Dec. 18, 2008.
English machine translation of DE112007001314, published on Apr. 23, 2009.
English machine translation of DE112010001135, published on Aug. 2, 2012.
English machine translation of DE112011104642, published on Oct. 2, 2013.
English machine translation of DE202006017010, published on Feb. 8, 2007.
English machine translation of DE202012101457, published on Aug. 16, 2012.
English machine translation of DE3734355, published on Jun. 29, 1989.
English machine translation of FR2812531, published on Nov. 5, 2004.
English machine translation of JP2004121722, published on Apr. 22, 2004.
English machine translation of JP2005040246, published on Feb. 17, 2005.
English machine translation of JP2005211350, published on Aug. 11, 2005.
English machine translation of JP2009261501, published on Nov. 12, 2009.
English machine translation of JP2010081968, published on Apr. 15, 2010.
English machine translation of JP2000140533, published on May 23, 2000.
English machine translation of JP2005087508, published on Apr. 7, 2005.
English machine translation of JP2010227287, published on Oct. 14, 2010.

* cited by examiner

PORTABLE SURFACE CLEANING APPARATUS

CROSS REFERENCE TO PREVIOUS APPLICATIONS

This application is a continuation of U.S. patent application Ser. No. 18/345,395, filed on Jun. 30, 2023 now U.S. Pat. No. 12,048,409, which itself is a continuation of co-pending U.S. patent application Ser. No. 17/367,538, filed on Jul. 5, 2021 and issued as U.S. Pat. No. 11,751,733 on Sep. 12, 2023; which itself is a continuation of co-pending U.S. patent application Ser. No. 17/196,380, filed on Mar. 9, 2021 and issued as U.S. Pat. No. 11,622,659 on Apr. 11, 2023; which itself is a continuation of co-pending U.S. patent application Ser. No. 15/931,973, filed on May 14, 2020 and issued as U.S. Pat. No. 11,529,031 on Dec. 20, 2022; which itself is a continuation of co-pending U.S. patent application Ser. No. 16/022,902, filed on Jun. 29, 2018 and issued as U.S. Pat. No. 11,330,944 on May 17, 2022; which itself is a continuation of U.S. patent application Ser. No. 15/012,783, filed on Feb. 1, 2016 and issued as U.S. Pat. No. 10,548,442 on Feb. 4, 2020; which itself is a continuation of U.S. patent application Ser. No. 14/874,544, filed on Oct. 5, 2015 and issued as U.S. Pat. No. 9,826,868 on Nov. 28, 2017; which itself is a continuation of U.S. patent application Ser. No. 13/255,875, filed on Sep. 9, 2011 and issued as U.S. Pat. No. 9,204,769 on Dec. 8, 2015; which itself was a national phase entry of application PCT/CA2010/000342 filed on Mar. 9, 2010, and said patent application claimed priority from Canadian patent application no. 2,658,372, filed on Mar. 13, 2009, and U.S. patent application Ser. No. 18/345,395 application is also a continuation-in-part of U.S. patent application Ser. No. 16/549,189, filed on Aug. 23, 2019, which itself is a continuation of U.S. patent application Ser. No. 16/022,845, filed on Jun. 29, 2018 and issued as U.S. Pat. No. 10,433,686 on Oct. 8, 2019, which itself is a continuation of U.S. patent application Ser. No. 15/406,434, filed on Jan. 13, 2017 and issued as U.S. Pat. No. 10,561,286 on Feb. 18, 2020, which itself is a continuation of U.S. patent application Ser. No. 14/470,342, filed on Aug. 27, 2014, which is abandoned and which itself is a continuation of U.S. patent application Ser. No. 12/721,128, filed on Mar. 10, 2010, which claimed priority from Canadian Patent Application no. 2,658,005, and issued as U.S. Pat. No. 8,950,039, on Feb. 10, 2015, which itself is (a) a continuation-in-part of U.S. patent application Ser. No. 12/675,512 filed Feb. 26, 2010 entitled CYCLONIC SURFACE CLEANING APPARATUS WITH A SPACED APART IMPINGEMENT SURFACE, which is abandoned and which was a national phase entry of PCT/CA2008/001531 which claimed priority from CA2,599,303, and is (b) a continuation-in-part of U.S. patent application Ser. No. 12/675,540 filed on Feb. 26, 2010 entitled CYCLONIC SURFACE CLEANING APPARATUS WITH EXTERNALLY POSITIONED DIRT CHAMBER, and issued as U.S. Pat. No. 9,027,201 on May 12, 2015, and which was a national phase entry of PCT/CA2008/001530 which claimed priority from CA2,599,303; and, is (c) a continuation-in-part of U.S. patent application Ser. No. 12/675,636 filed Feb. 26, 2010 entitled CYCLONIC SURFACE CLEANING APPARATUS WITH SEQUENTIAL FILTRATION MEMBERS which is abandoned and which was a national phase entry of PCT/CA2008/001519 which claimed priority from CA2,599,303.

each of which is incorporated herein by reference in its entirety.

FIELD

The specification relates to surface cleaning apparatuses. More specifically, the specification relates to cyclonic surface cleaning apparatuses.

BACKGROUND OF THE INVENTION

The following is not an admission that anything discussed below is prior art or part of the common general knowledge of persons skilled in the art.

Cyclonic vacuum cleaners utilize one or more cyclones that have an associated dirt collection chamber. The dirt collection chamber may be formed in the bottom of a cyclone chamber. A disc or divider may be positioned in the cyclone casing to divide the cyclone casing into an upper cyclone chamber and a lower dirt collection chamber. In it also known to position a dirt collection chamber exterior to a cyclone casing, such as surrounding the cyclone chamber.

SUMMARY OF THE INVENTION

The following introduction is provided to introduce the reader to the more detailed discussion to follow. The introduction is not intended to limit or define the claims.

According to one broad aspect, a surface cleaning apparatus is provided that utilizes a cyclone having an open end, wherein the open end comprises the dirt outlet of the cyclone. A plate, that preferably has a planar surface facing the open end, is positioned facing the open end. For example, the plate may line in a plane that is perpendicular to the longitudinal axis extending through a cyclone chamber and may be spaced from the open end. Accordingly, a gap is provided between the plate and the open and defines a dirt outlet of the cyclone. In accordance with this aspect, the gap has a non-uniform length.

For example, the cyclone casing may have a variable length. The portion that have a shorter length define a gap having an increased height. Alternately, or in addition, the plate may be provided with a sidewall on the side of the plate facing the open end of the cyclone. The sidewall may extend part way around the plate. The height of the wall may be constant or may be variable.

The sidewall is preferably provided on the periphery of the plate. The diameter of the plate is preferably about the same as the diameter of the open end of the cyclone.

In some embodiments, the sidewall of the plate has a constant length. In other embodiments, the sidewall of the plate has a variable length.

In some embodiments, the sidewall of the cyclone has a first end at the open end, the first end has a perimeter, and the gap has a first portion having a first length and a second portion having a second length greater than the first length. The first length and the second length may be constant. Alternately, the first length and the second length may be variable.

In some embodiments, one of the portions extends up to 210° of the perimeter. For example, the second portion may extend up to 210° of the perimeter. In other embodiments, the second portion extends up to 240° of the perimeter.

According to another broad aspect, a surface cleaning apparatus is provided. The surface cleaning apparatus comprises an air flow passage extending from a dirty air inlet to a clean air outlet. A suction motor is positioned in the air flow passage. A cyclone is positioned in the air flow passage. The cyclone comprises an air inlet, an air outlet, an open end, a longitudinal axis and a longitudinally extending sidewall. The side wall has a variable length. A dirt collection chamber is in flow communication with the open end.

In some embodiments, a first portion of the sidewall is longer than a second portion of the sidewall.

In some embodiments, the sidewall has a first end at the open end, the first end has a perimeter, and the first portion comprises up to 240° of the perimeter and the second portion comprises from up to 120° of the perimeter.

In some embodiments, the surface cleaning apparatus further comprises a plate facing the open end. The plate may be spaced from a front end wall of the surface cleaning apparatus. A first portion of the dirt collection chamber may be provided between the plate and the front end wall. Preferably, a second portion of the dirt collection chamber surrounds at least a portion of the cyclone.

According to another broad aspect, another surface cleaning apparatus is provided. The surface cleaning apparatus comprises an air flow passage extending from a dirty air inlet to a clean air outlet. A suction motor is positioned in the air flow passage. A cyclone is positioned in the air flow passage. The cyclone comprises an air inlet, an air outlet, an open end, a longitudinal axis and a longitudinally extending sidewall. A plate is provided having a cyclone side facing the open end. The plate is positioned to define a gap between the plate and the open end of the cyclone. The plate has a plate sidewall extending towards the open end. A dirt collection chamber is in flow communication with the open end.

In some embodiments, the plate sidewall extends part way around the plate. In some embodiments, the sidewall of the plate has a constant length. In other embodiments, the sidewall of the plate has a variable height.

Any of the surface cleaning apparatuses described herein may comprise a portable vacuum cleaner, and preferably, a hand vacuum cleaner. The portable vacuum cleaner may be removably mountable to an upright vacuum cleaner.

It will be appreciated that an embodiment may contain one or more of features set out in the examples.

BRIEF DESCRIPTION OF THE DRAWINGS

In the detailed description, reference will be made to the following drawings, in which.

DETAILED DESCRIPTION OF THE INVENTION

Figure 1:
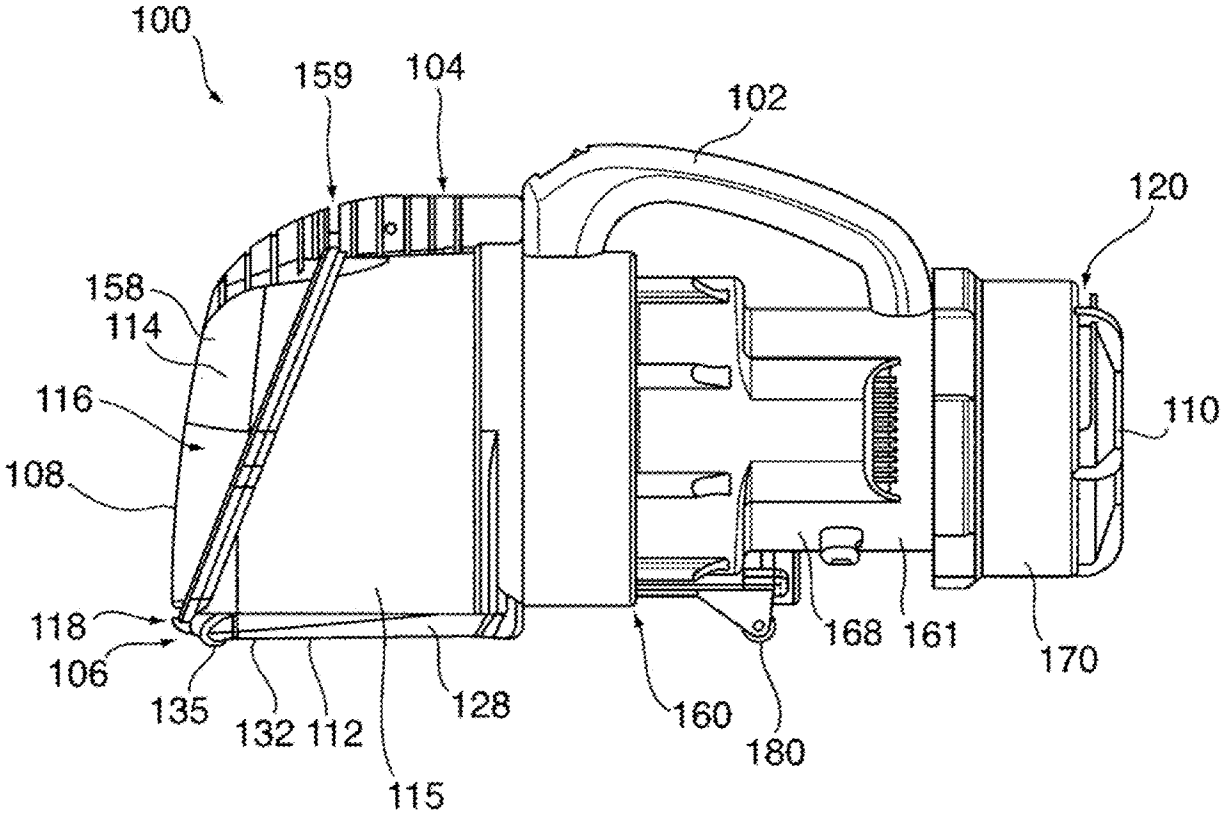
FIG. 1 is a side plan view of an example of a hand vacuum cleaner.
Figure 2:
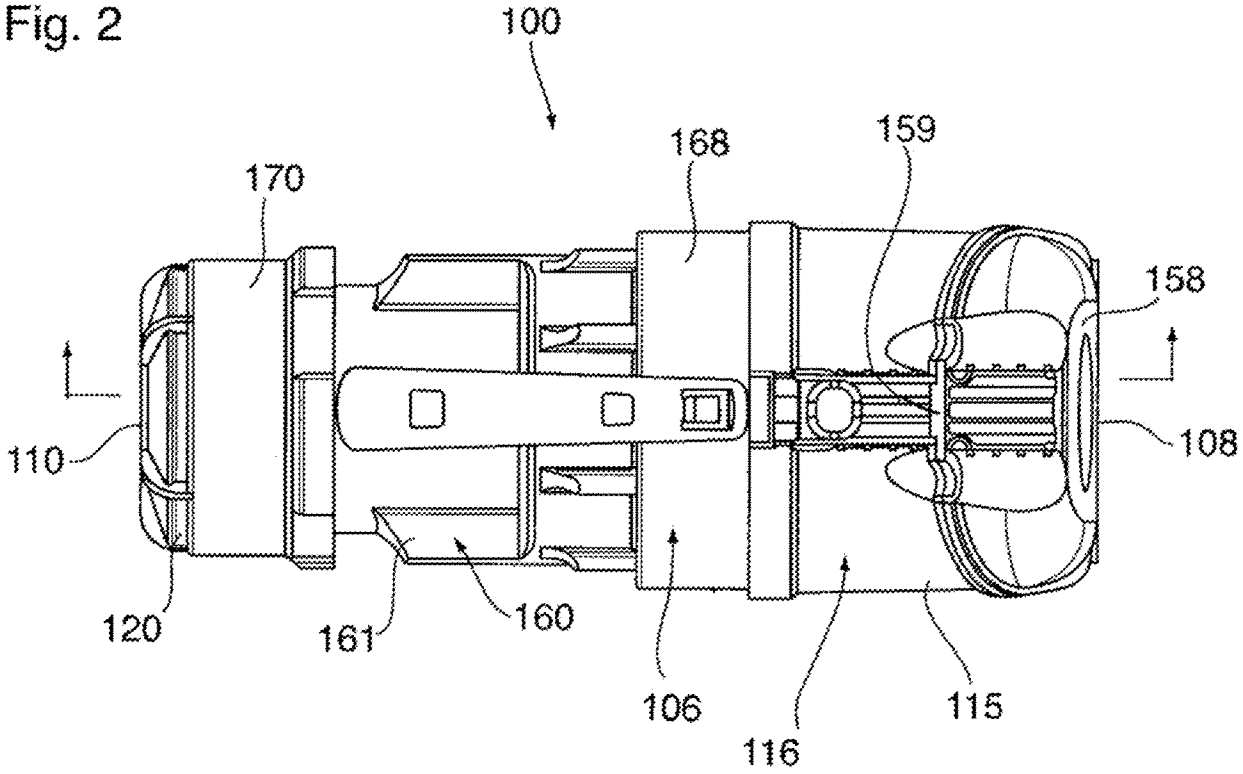
FIG. 2 is a top plan view of the hand vacuum cleaner of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Referring to FIGS. 1 to 7, a first example of a surface cleaning apparatus 100 is shown. Preferably, the surface cleaning apparatus 100 (also referred to herein as cleaner 100 or vacuum cleaner 100) is a portable vacuum cleaner 100, such as a hand vacuum cleaner 100 as shown. The hand vacuum cleaner 100 is movable along a surface to be cleaned by gripping and maneuvering handle 102. In alternate embodiments, the surface cleaning apparatus 100 may be another type of surface cleaning apparatus, such as a stick-vac, an upright vacuum cleaner, or a canister vacuum cleaner.

The exemplified embodiments are hand vacuum cleaners. The design for a cyclone and facing plate having a gap therebetween of non-uniform height may be used in any cyclonic cleaning apparatus. If the feature is used with a portable surface cleaning apparatus such as a hand vacuum cleaner, then the portable surface cleaning apparatus may be of any design. For example, as exemplified, the vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110 and may be of any design. The vacuum cleaner 100 may be of various configurations (e.g., different positioning and orientation of the cyclone unit and the suction motor and differing cyclone units that may comprise one or more cyclones and one or more filters) and may use any type of nozzle or position of the nozzle.

In the example shown, the vacuum cleaner 100 comprises a nozzle 112, which may be of any design, and a cyclone unit 114, which together form a surface cleaning head 116 of the vacuum cleaner 100. As exemplified, the surface cleaning head 116 is preferably provided at the front 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Cyclone unit 114 is provided in the airflow passage, downstream of the dirty air inlet 118. In the example shown, the cyclone unit 114 comprises one cyclone 122 positioned in the airflow passage, and one dirt chamber 124. In alternate examples, the cyclone unit 110 may include more than one cyclonic stage, wherein each cyclonic stage comprising one or more cyclones and one or more dirt chambers. Accordingly, the cyclones may be arranged in parallel and/or in sequence.

Figure 6:
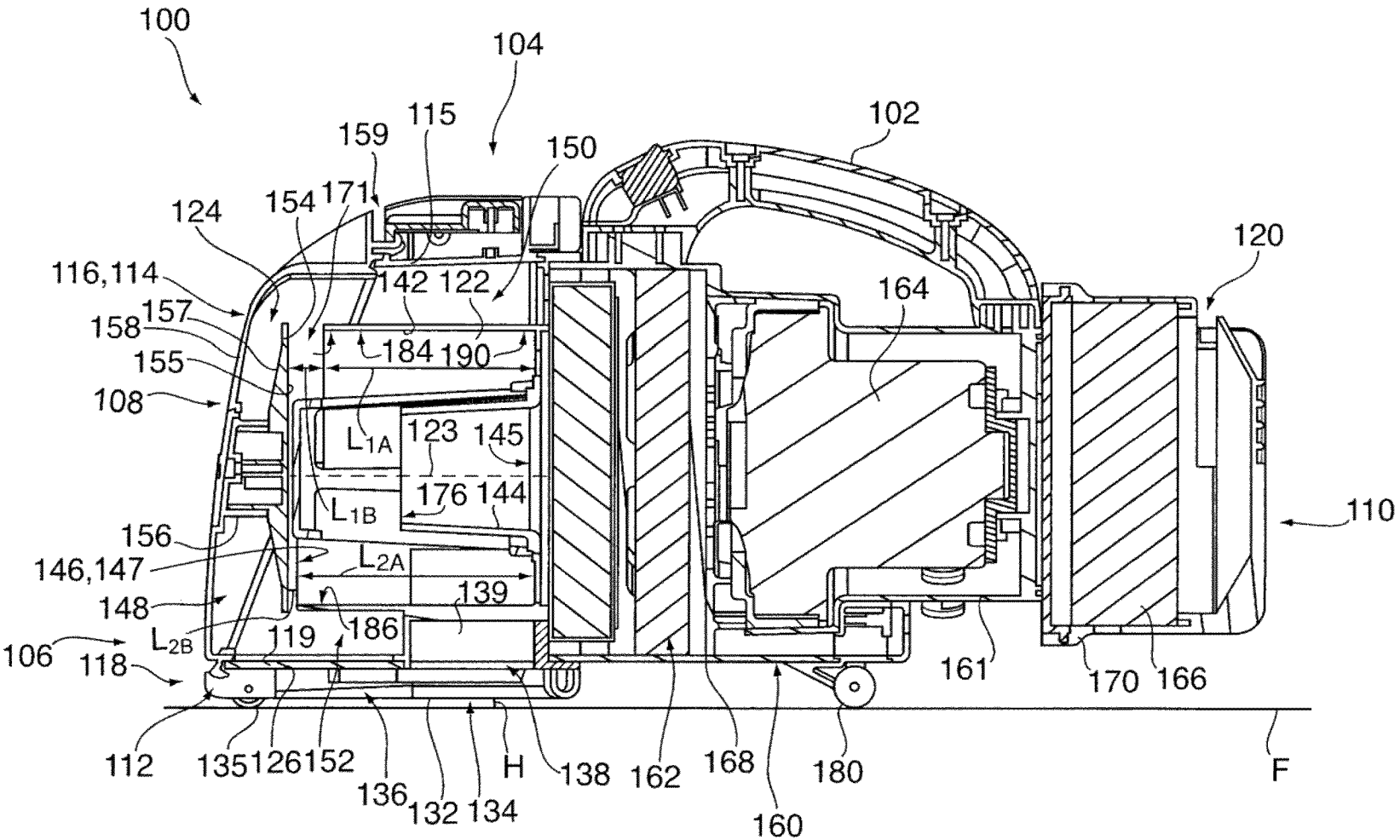
FIG. 6 is a cross section taken along line 6-6 in FIG. 2.
Figure 7:
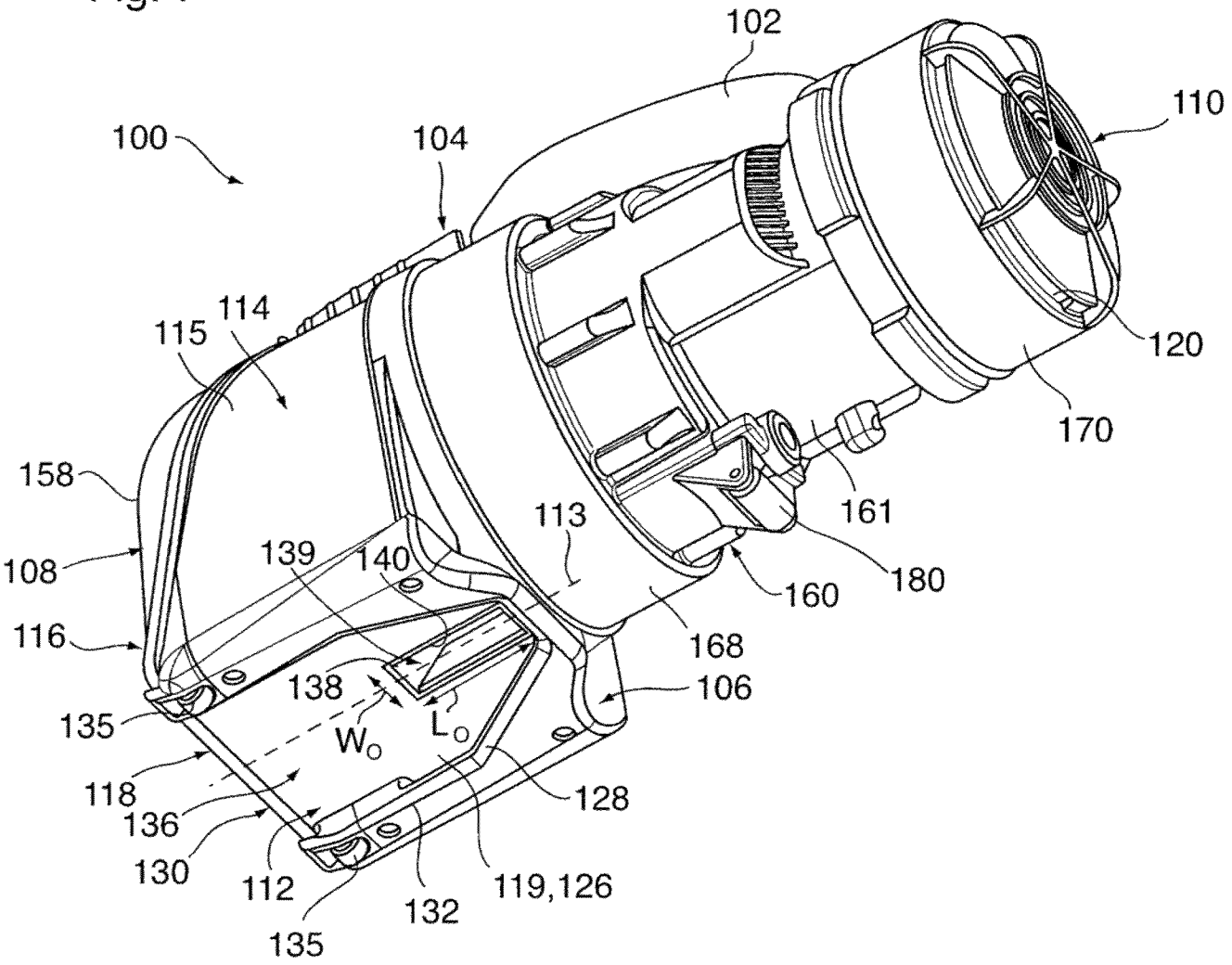
FIG. 7 is a bottom perspective view of the hand vacuum cleaner of FIG. 1.
Figure 8:
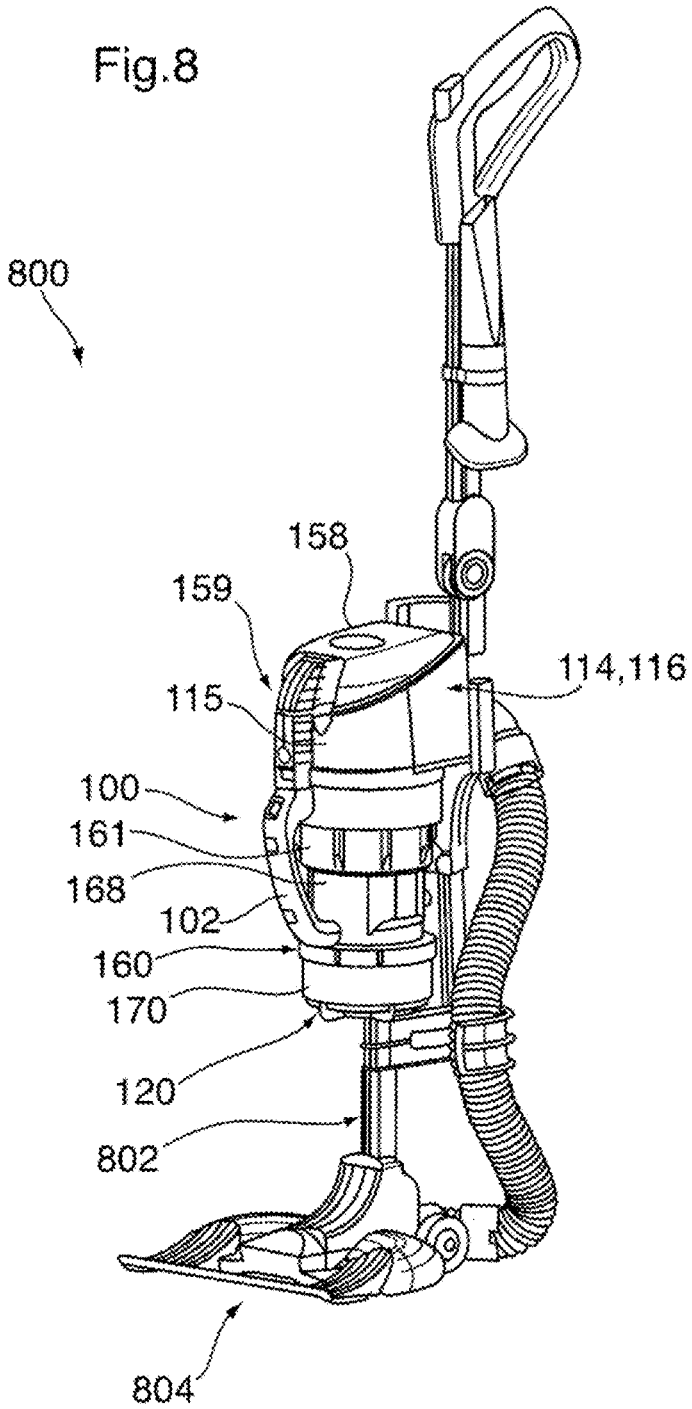
FIG. 8 is a perspective illustration of the surface cleaning apparatus of FIG. 1 mounted to an upright vacuum cleaner.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. Accordingly, as exemplified, nozzle 112 may be on lower surface 117 of cyclone unit 114. In a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
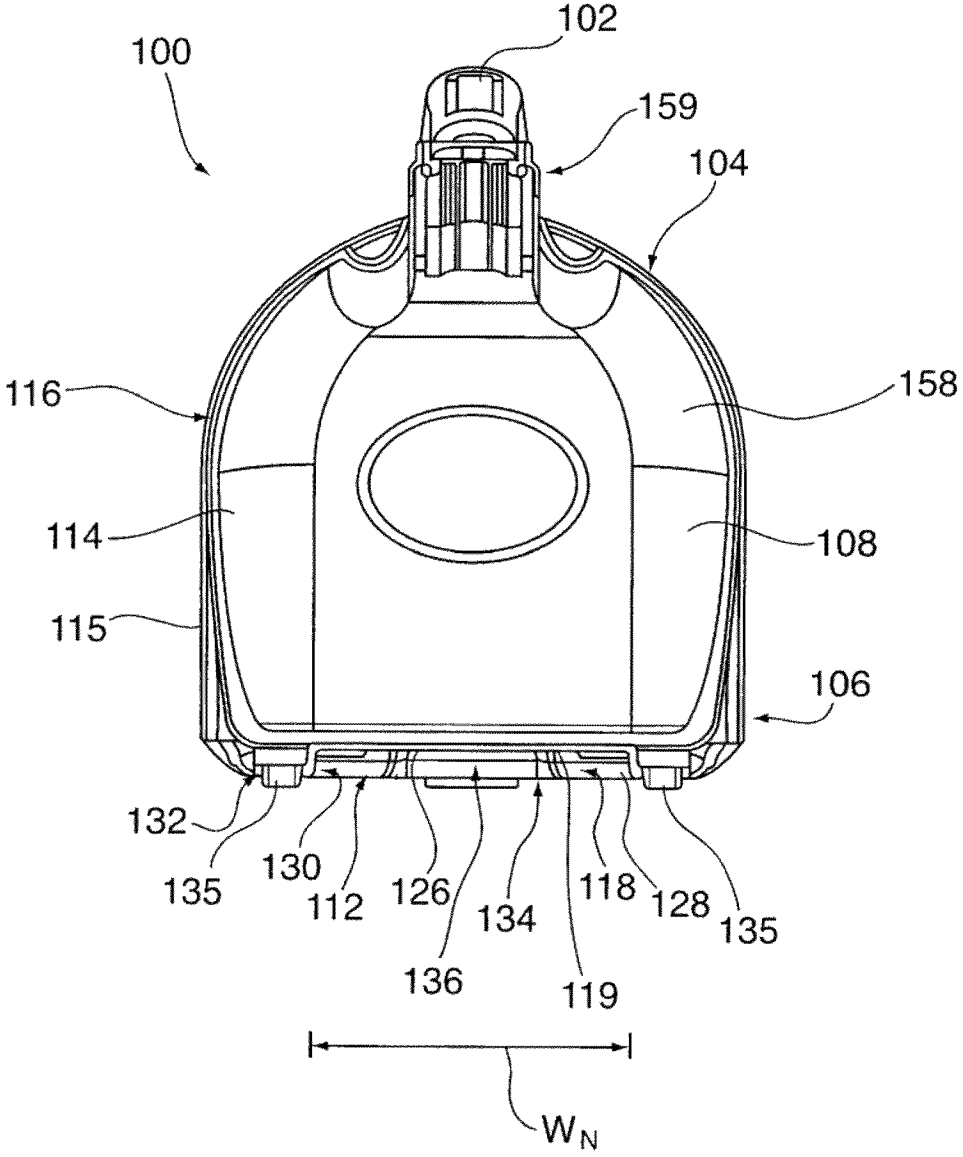
FIG. 3 is a front plan view of the hand vacuum cleaner of FIG. 1.
Figure 4:
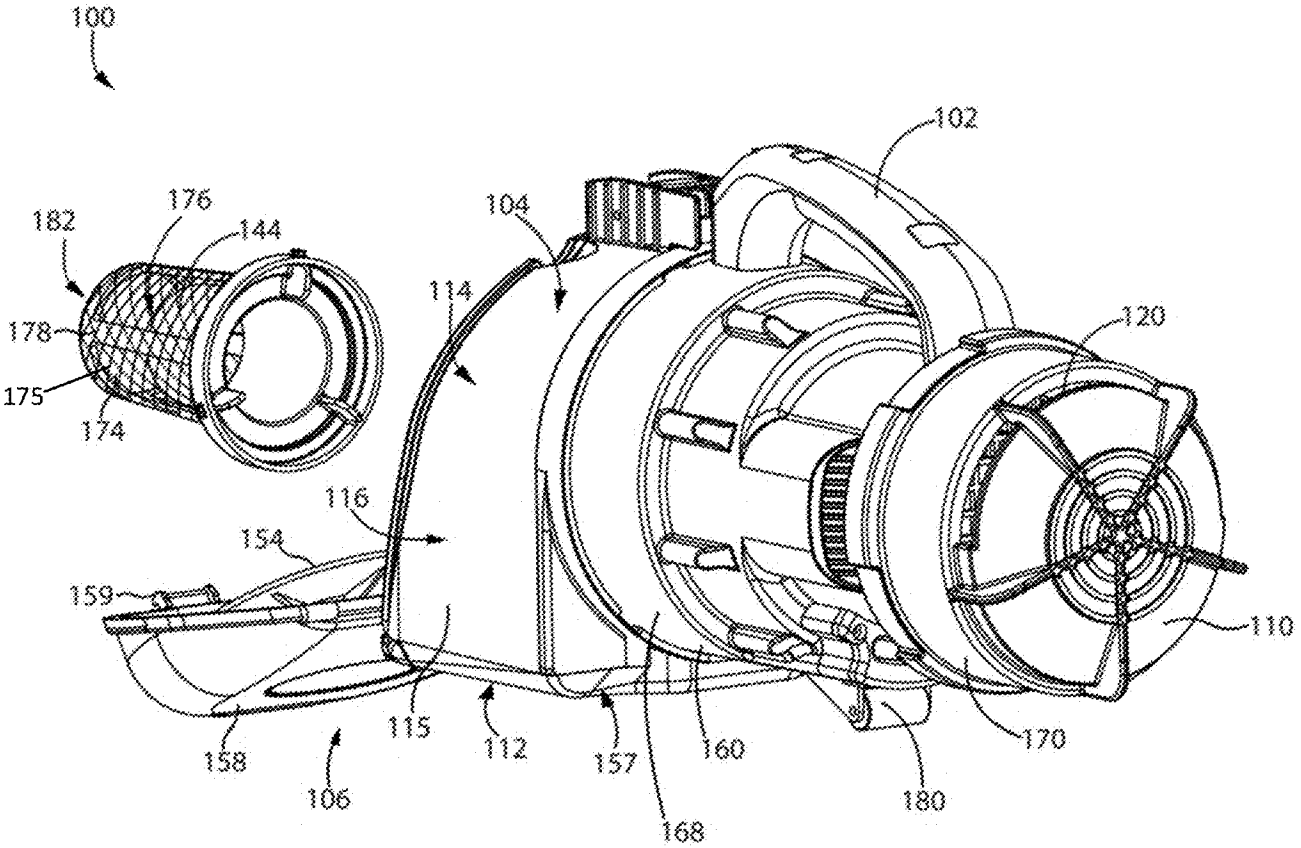
FIG. 4 is a partially exploded rear perspective view of the hand vacuum cleaner of FIG. 1.
Figure 5:
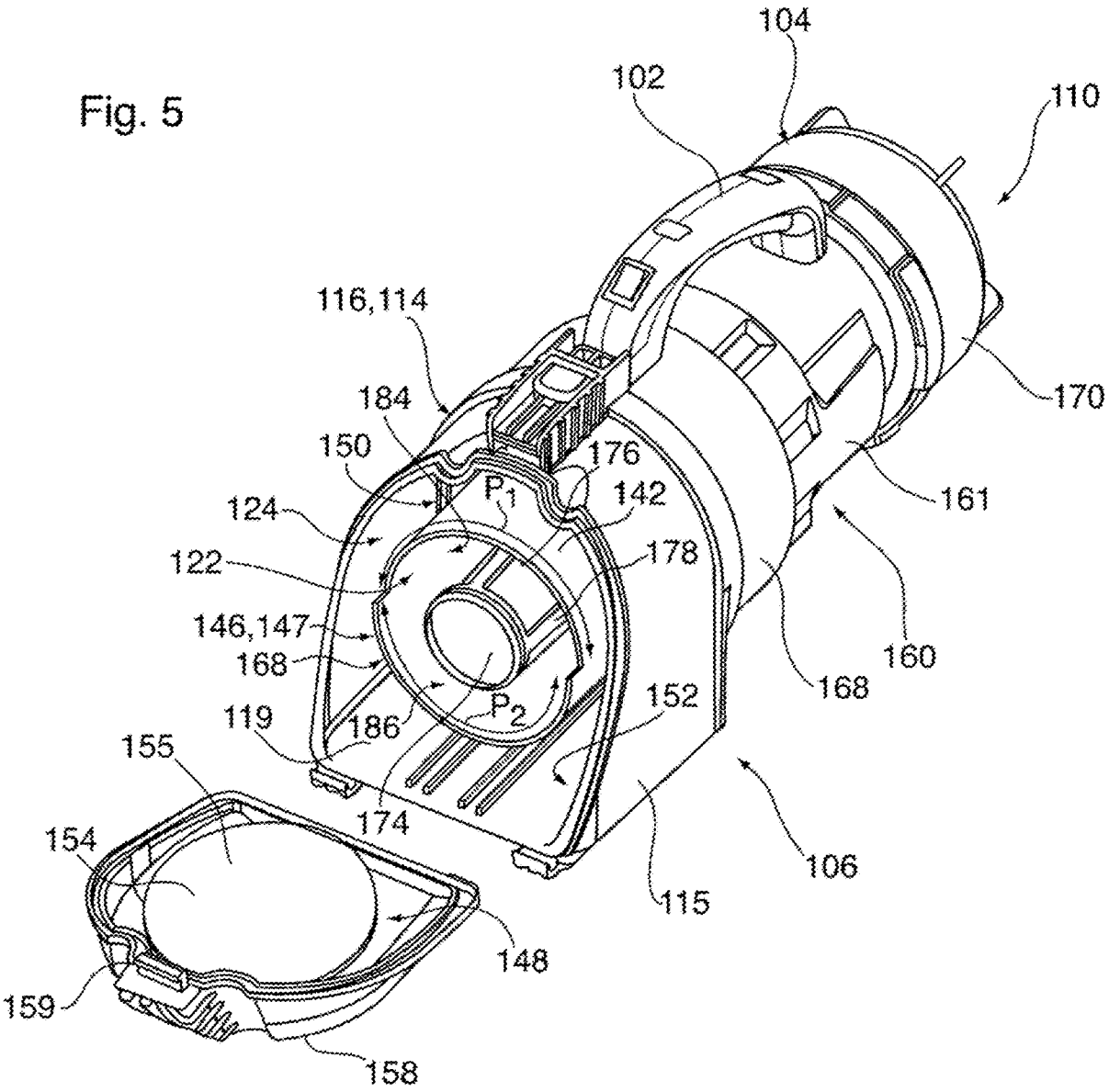
FIG. 5 is a partially exploded front perspective view of the hand vacuum cleaner of FIG. 1.

As shown in FIGS. 3 and 5, nozzle 112 has a width WN, and cyclone unit 114 has a width WC. In the example shown, WN, and WC are about the same. An advantage of this design is that the nozzle may have a cleaning path that is essentially as wide as the hand vacuum itself.

Preferably, nozzle 112 comprises an airflow chamber wherein at least a portion, and preferably a majority, of the lower surface of the chamber is open. In an alternate design, the nozzle may comprise a lower wall, which closes the lower end. Accordingly, nozzle 112 may be of various design and may be an open sided passage or a closed passage.

Nozzle 112 may also share a common wall with another component of cyclone unit 114. As exemplified in FIG. 7, nozzle 112 comprises an upper nozzle wall 126, which defines a closed upper end of the airflow chamber 136. In the example shown, the upper nozzle wall 126 comprises a lower portion 119 of a wall 115 of the cyclone unit.

Preferably, one or more depending walls 128 extend downwardly from the upper nozzle wall 126. The depending wall is preferably generally U-shaped. In one embodiment, depending wall is provided rearward of opening 138. In other embodiments, depending walls may alternately or in addition be provided on the lateral sides of opening 138. It is preferred that depending walls are provided on each lateral side of opening 138 and rearward thereof. Further, depending walls 128 may extend a substantial distance to the front end 108 and, preferably, essentially all the way to front end 108. The depending walls may be continuous to define a single wall as shown, or may be discontinuous. The depending walls are preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on floor F, lower end 132 of depending wall 128 is spaced a distance H above the floor. Preferably distance H is from 0.01 to 0.175 inches, more preferably from 0.04 to 0.08 inches.

The height of the depending wall (between upper nozzle wall 126 and lower end 132) may vary. In some examples, the depending wall may have a height of between about 0.05 and about 0.875 inches, preferably between about 0.125 and about 0.6 inches and more preferably between about 0.2 and about 0.4 inches. The height of depending wall may vary but is preferably constant.

As exemplified, the open end of the U-shape defines an open side 130 of the nozzle 112, and forms the dirty air inlet 118 of the cleaner 100. In the example shown, the open side 130 is provided at the front of the nozzle 112. In use, when optional wheels 135 are in contact with a surface, the open side 130 sits above and is adjacent a surface to be cleaned (e.g. floor F). Preferably, lower end 132 of depending walls 128 is spaced above floor F. Accordingly, some air may enter nozzle 112 by passing underneath depending wall 132. In such a case, the primary air entry to nozzle 112 is via open side 130 so that dirty air inlet 118 is the primary air inlet, with a secondary air inlet being under depending wall 128. In the example shown, the lower end 132 of the depending wall 128 defines an open lower end 134 of the nozzle 112. The open lower end 134 preferably extends to the front 108 of the cleaner 108, and merges with the open side 130.

In use, the exemplified nozzle has an open lower end 134 that faces a surface to be cleaned. In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from a surface to be cleaned, and the space between the lower end of the depending wall 128 and the surface to be cleaned form a secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 is provided. Preferably, the wheels are located adjacent front 108. Optionally, one or more rear wheels 108 may be provided. In an alternate embodiment, no wheels may be provided.

The upper nozzle wall 126, depending wall 128, and open lower end 134 of the nozzle 112 define an open sided airflow chamber 136 of the nozzle. In use, when wheels 135 are in contact with a horizontal surface, the nozzle 112 and the airflow chamber 136 extend generally horizontally, and preferably linearly along a nozzle axis 113 (see FIG. 7).

An opening 138 is provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with an air inlet 140 of cyclone 122.

Referring to FIGS. 5 and 6, cyclone 122 comprises a longitudinally extending sidewall 142. In the example shown, the longitudinally extending sidewall 142 is substantially cylindrical. The cyclone chamber is located inside chamber wall 142. The cyclone 122 extends along a longitudinal axis 123. Preferably, as shown, axis 123 is parallel to the nozzle axis, and extends generally horizontally when cleaner 100 is in use and wheels 135 are seated on a surface.

Cyclone 122 further comprises an air inlet 140, and an air outlet 145. The cyclone air inlet and cyclone air outlet may be of any configuration known in the art. The cyclone 122 further comprises an open end 147. The open end 147 comprises a dirt outlet 146 of the cyclone 122.

As exemplified, the cyclone air inlet 140 is defined by an aperture in the chamber wall 142. As can be seen in FIG. 5, the inlet passage 139 is at configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, which is in communication with outlet 145. The dirt that is separated from the air exits the cyclone via dirt outlet 146 defined by open end 147, and enters dirt chamber 124.

As exemplified in FIG. 6, a shroud 174 may be provided adjacent outlet passage 144, spaced from and facing the inlet 176 to outlet passage 144. Shroud 174 may be mounted to cyclone 122 via legs 178. In the example shown, shroud 174, and legs 178 form an assembly 182 that is removably mounted in cyclone 122. In some examples, a screen 175 may be mounted around legs 178. Shroud 174 may be of any design.

As noted hereinabove, the open end 147 of the cyclone 122 is in communication with a dirt chamber 124. In the example shown, dirt chamber 124 comprises two portions. A first portion 148 is provided forwardly of the dirt outlet 146. A second portion 150 is concentric with the cyclone 122, and surrounds at least a portion of the cyclone 122. A lower portion 152 of the second portion 150 is below the cyclone. As exemplified, nozzle 112 is positioned below first portion 148, and lower portion 152.

Preferably, the surface cleaning apparatus comprises a plate 154 facing the open end 147 of the cyclone. Preferably, the plate 154 has a cyclone side 155 facing the open end 147, and a dirt bin side 157 facing front wall 158. The cyclone side 155 is preferably planar. For example, as exemplified, cyclone side may be oriented to be perpendicular to the cyclone axis 123. Preferably, plate 123 is spaced for the open end of the cyclone. Preferably, the diameter of plate 154 and the diameter of the open end are about the same. The plate may be slightly smaller and/or slightly larger (e.g., +/−10%).

As shown, plate 154 may be provided in the dirt chamber 124, and is spaced from a front wall 158 at the front 108 of the cleaner. Accordingly, the first portion 148 of dirt chamber 124 is provided between dirt bin side 157 of plate 154 and a front end wall 158 of the surface cleaning apparatus.

Preferably, the plate is positioned to define a gap 171 between the plate 154 and the open end 147 of the cyclone 122. More preferably, the gap has a variable length in the direction of the longitudinal axis 123 of the cyclone 122.

For example, as shown in FIGS. 5 and 6, the sidewall 142 of cyclone 122 has a variable length. That is, as shown, a first portion 184 of the sidewall 142 is longer than a second portion 186 of the sidewall. Accordingly, in this embodiment, the variable length of the sidewall of the cyclone provides the variable length of the gap.

In the embodiment shown, first portion 184 of the sidewall 142 has a first length L1A, and second portion 186 of the sidewall 142 has a second length L2A. Accordingly, the gap has a first length L1B adjacent the first portion 184 of the sidewall, and a second length L2B adjacent the second portion 186 of the sidewall. In the embodiment shown, the second length L2A is greater than the first length L1A. Accordingly, the first length L1B of the gap 171 is greater than the second length L2B of the gap 171.

Preferably, the first length L1A of the first portion 184 and the first length L2A of the second portion are constant. More preferably, the first length L1B of the gap 171 and the second length L2B of the gap 171 are constant. In alternate embodiments, however, one or both of the first length L1B of the gap 171 and the second length L2B of the gap 171 may be variable.

In the exemplified embodiment, sidewall 142 has a first end 188 at open end 147, and a second end 190 opposed to the first end. The first end has a perimeter. Preferably, in embodiments wherein the first length L1A and the second length L2A are constant, one of first portion 184 and second portion 186 extends up to 210° of the perimeter. For example, the first portion 184 may extend up to 210° of the perimeter. For example, as shown, first portion 184 extends for about 180° of the perimeter (indicated by arrow P1) and the second portion 186 extends for about 180° of the perimeter (indicated by arrow P2).

In alternate embodiments, wherein the first length L1A and/or the second length L2B are variable, one of first portion 184 and second portion 186 preferably extends up to 240° of the perimeter. For example, the first portion may comprise 240° of the perimeter, and the second portion may comprise 120° of the perimeter. In such an embodiment, the face of the wall facing the open end of the cyclone may extend upwardly at an angle.

It will be appreciated that in alternate embodiments, a cyclone 122 having a variable length may be useful, even if a plate 154 is not provided.

Figure 9:
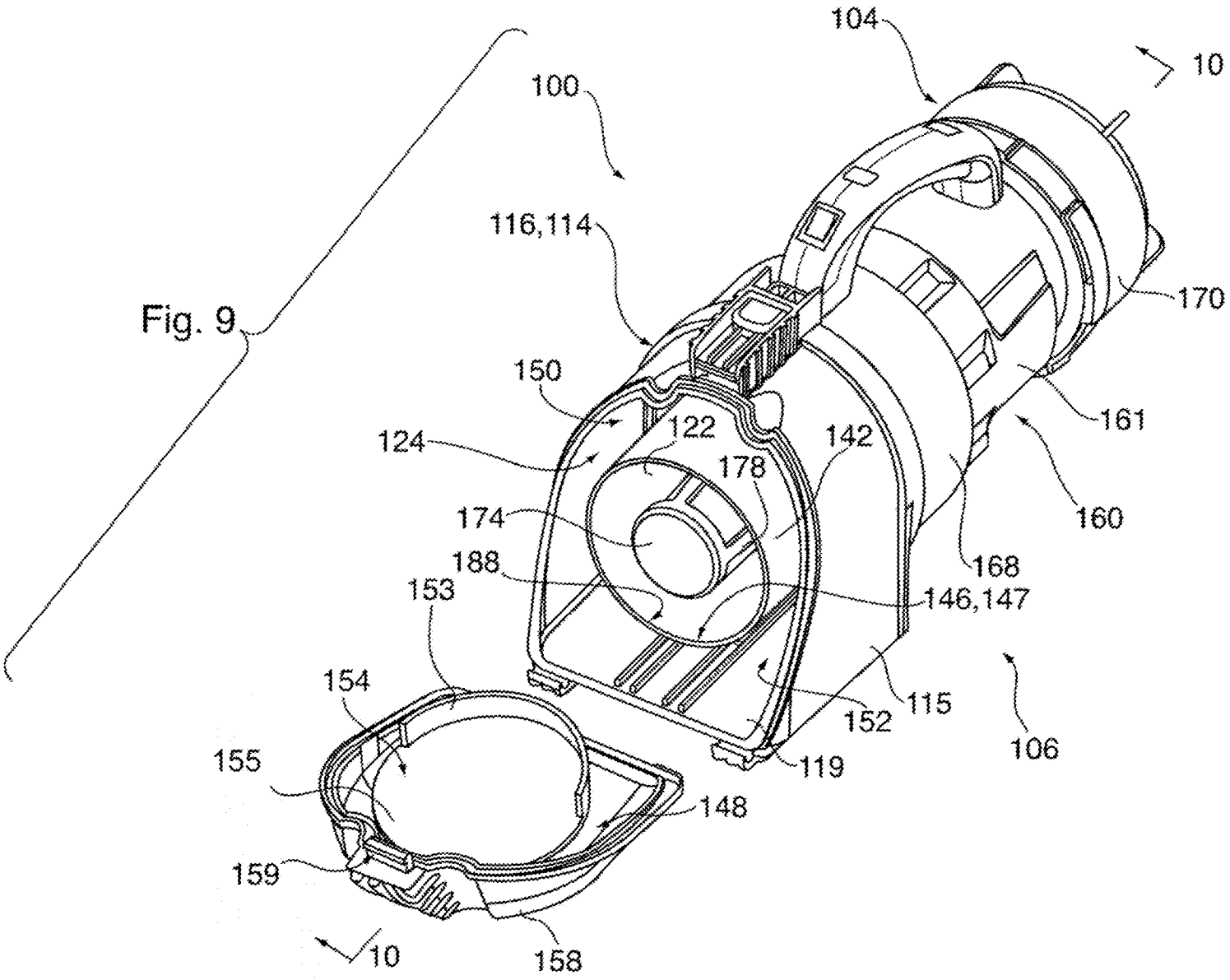
FIG. 9 is a partially exploded front perspective view of an alternate embodiment of a hand vacuum cleaner; and, FIG. 10 is a cross section taken along line 10-10 in FIG. 9.
Figure 10:
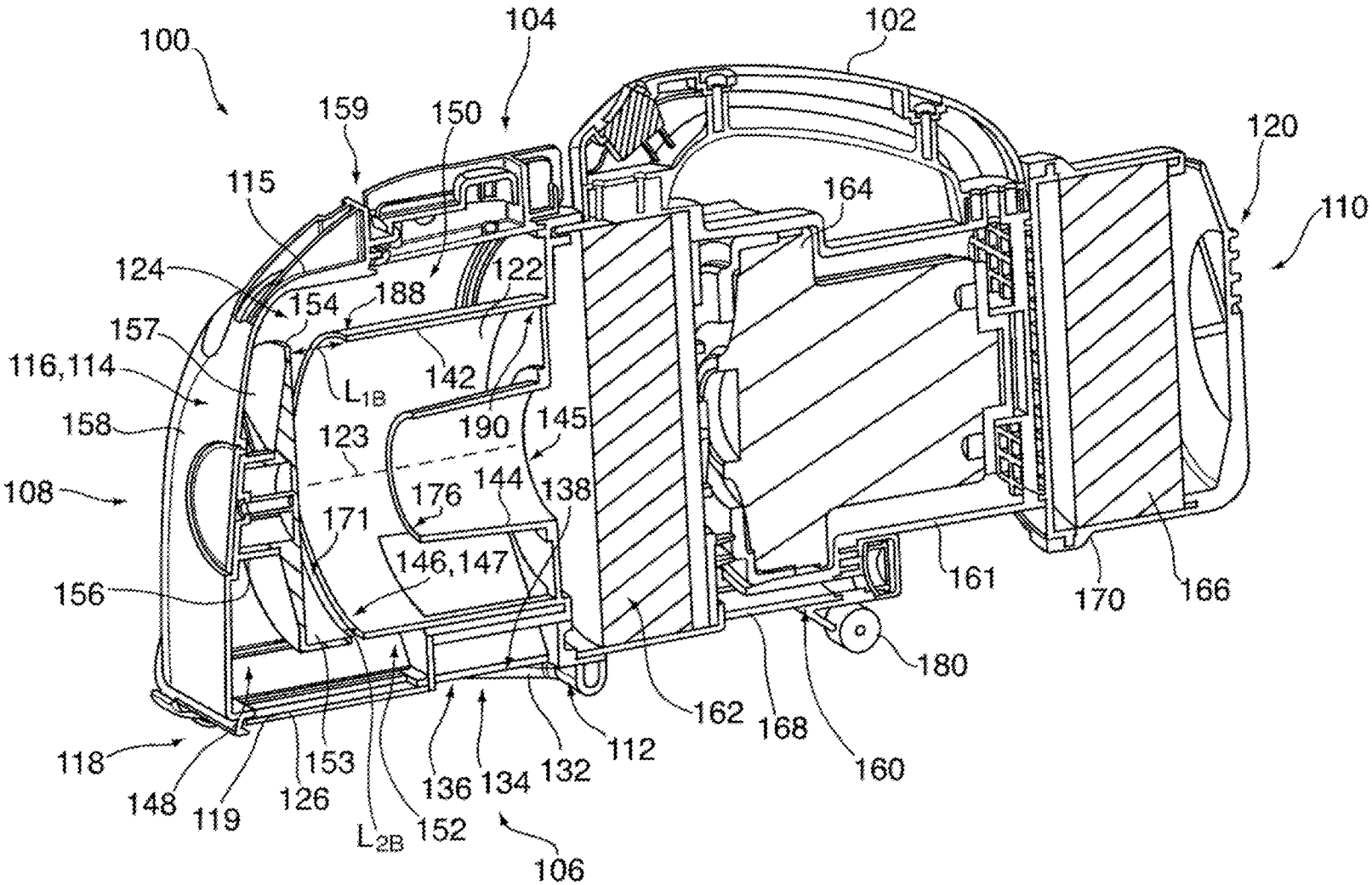

Alternately or in addition, as exemplified in FIGS. 9 and 10, the plate 154 may have a plate sidewall 153 extending towards the open end 147. Preferably, the plate sidewall 153 is at the periphery of the plate. In the embodiment shown, the plate sidewall 153 extends part way around the plate 154. Accordingly, in this embodiment, the space between the plate sidewall and the open end of the cyclone defines the variable length of the gap, and gap 171 has a first length L1B between the plate 154 and the end 188 of cyclone 122, and a second length L2B between the sidewall 153 and the end 188 of cyclone 122 that is less than the first length L1B In some embodiments, as shown, the sidewall 153 of the plate 154 has a constant length.

In a alternate embodiments, the plate sidewall 154 may extend all the way around the plate 154, and may have a variable length.

Plate 154 may be mounted by any means to any component in cyclone unit 114. As exemplified, the separation plate is mounted on an arm 156, which extends from a front wall 158 at the front 108 of the cleaner 100.

Cyclone unit 114 may be emptied by any means known in the art. For example, one of the ends of the cyclone unit 114 may be openable. As exemplified in FIGS. 4 and 5, front wall 158 is pivotably mounted to the cyclone unit wall 115, such that cyclone unit 114 may be opened, and dirt chamber 124 may be emptied. When front wall 158 is pivoted away from the remainder of the cyclone unit 114, separation plate 154 and arm 156 also pivot away from the remainder of the cyclone unit. A latch 159 is provided, which secures front wall 158 to wall 115. In alternate examples, front wall 158 may be removable from cyclone unit wall 115 or the opposed end of the cyclone unit 114 may be openable.

The clean air exiting cyclone 122 passes through outlet passage 144, exits surface cleaning head 116, and passes into the cleaner body 160. The air exiting the cyclone may be subjected to one or more treatment stages (e.g., cyclonic and/or filtration). In the example shown, a cleaner body 160 is positioned rearward of the surface cleaning head 116. The cleaner body comprises a housing 161, which preferably houses an optional pre-motor filter assembly 162, a suction motor 164, and an optional post-motor filter 166.

In the exemplified embodiments, the vacuum cleaner has a linear configuration. Accordingly, pre-motor filter assembly 162 is preferably provided in the airflow path adjacent and downstream of the outlet passage 144. Pre-motor filter assembly 162 serves to remove remaining particulate matter from air exiting the cyclone 122, and may be any type of filter, such as a foam filter. One or more filters may be used, as shown. If the vacuum cleaner is of a non-linear configuration, then pre-motor filter assembly 162 need not be located adjacent outlet passage 144.

Suction motor 164 is provided in the airflow path preferably adjacent and downstream of the pre-motor filter 162. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 122 extend in the same direction and are generally parallel. The suction motor 164 may be any type of suction motor. If the vacuum cleaner is of a non-linear configuration, then motor 164 need not be located adjacent pre-motor filter 162.

Post motor filter 166 is provided in the airflow path downstream of, and preferably adjacent, the suction motor 164. Post motor filter serves to remove remaining particulate matter from air exiting the cleaner 100. Post-motor filter 166 may be any type of filter, such as a HEPA filter.

Clean air outlet 120 is provided downstream of post-motor filter 166. Clean air outlet 120 comprises a plurality of apertures preferably formed in housing 161.

Preferably, as in the example shown, cleaner body 160 is removably mounted to surface cleaning head 116. For example, cleaner body 160 may be entirely removable from surface cleaning head 116, or pivotably mounted to surface cleaning head 116. Accordingly, cleaner body 160 and surface cleaning head 116 may be separated in order to provide access to the interior of cleaner body 160 or surface cleaning head 116. This may allow pre-motor filter assembly 162 to be cleaned, changed, or serviced, or motor 164 to be cleaned, changed or serviced. Alternately, or in addition, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively. If no filter element is fixedly mounted to cleaning head 116, then cleaning head 116 may be removed and washed with water.

As can be seen in FIG. 6, housing 161 preferably comprises a first portion 168 housing pre-motor filter assembly 162, and suction motor 164, and a second portion 170 housing post-motor filter 166. Second portion 170 is openable, such as by being removably mounted to first portion 168, such that post-motor filter 166 may be cleaned, changed, or serviced.

One or more additional rear wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

As mentioned hereinabove, surface cleaning apparatus 100 is a preferably a portable vacuum cleaner 100, as shown in FIGS. 1 to 7.

What is claimed is:

1. A hand vacuum cleaner having an outer surface, the hand vacuum cleaner comprising:

(a) an air flow passage extending from a dirty air inlet to a clear air outlet;

(b) a housing having a housing front end, a housing rear end spaced apart from the housing front end in a rearward direction and a sidewall extending between the front and rear ends of the housing, the housing comprising a first portion that houses a suction motor that is positioned in the air flow passage, the suction motor having a suction motor axis of rotation; and, (c) a cyclone unit positioned in the air flow passage upstream from the suction motor, the cyclone unit comprising a cyclone unit front end, a cyclone unit rear end, a cyclone unit sidewall, a cyclone and a dirt collection region that is positioned forward of the cyclone, the cyclone unit front end having an openable door, the cyclone comprising a cyclone front end, a cyclone rear end, a cyclone air inlet, a cyclone air outlet and a cyclone axis of rotation which intersects the cyclone front end and the cyclone rear end, the cyclone air outlet comprising an assembly which includes a filter screen, wherein the assembly is moveable relative to the cyclone unit sidewall in a common direction with the cyclone axis of rotation.

2. The hand vacuum cleaner of claim 1 wherein the assembly and the sidewall are separable from each other while the openable door is in an open position.

3. The hand vacuum cleaner of claim 1 wherein the assembly and the sidewall are separable from each other while the openable door is in an open position and the openable door is attached to the sidewall.

4. The hand vacuum cleaner of claim 1 wherein the housing further comprising a second portion that is removably mounted to the first portion, the second portion defining a post-motor filter chamber which, in operation, houses a post-motor filter, wherein the cyclone axis of rotation extends through the post-motor filter chamber.

5. The hand vacuum cleaner of claim 1 wherein the housing further comprising a second portion defining a post-motor filter chamber which, in operation, houses a post-motor filter, wherein the cyclone axis of rotation extends through the post-motor filter chamber.

6. The hand vacuum cleaner of claim 1 wherein the cyclone unit is provided at the front end of the hand vacuum cleaner and the suction motor axis of rotation intersects the cyclone unit.

7. The hand vacuum cleaner of claim 1 wherein, when the openable door is in an open position, the dirt collection region is opened.

8. The hand vacuum cleaner of claim 1 wherein the suction motor axis of rotation and the cyclone axis of rotation extend in a common direction and each axis intersects the openable door when the openable door is in the closed position.

9. The hand vacuum cleaner of claim 8 wherein the housing further comprising a second portion that is removably mounted to the first portion, the second portion defining a post-motor filter chamber which, in operation, houses a post-motor filter, wherein each of the cyclone axis of rotation and the motor axis of rotation extends through the post-motor filter chamber.

10. The hand vacuum cleaner of claim 8 wherein the housing further comprising a second portion defining a post-motor filter chamber which, in operation, houses a post-motor filter, wherein each of the cyclone axis of rotation and the motor axis of rotation extends through the post-motor filter chamber.

11. A hand vacuum cleaner having an outer surface, the hand vacuum cleaner comprising:

(a) an air flow passage extending from a dirty air inlet to a clear air outlet;

(b) a housing having a housing front end, a housing rear end spaced apart from the housing front end in a rearward direction and a sidewall extending between the front and rear ends of the housing, the housing comprising a first portion that houses a suction motor that is positioned in the air flow passage, the suction motor having a suction motor axis of rotation;

(c) an air treatment unit positioned in the air flow passage upstream from the suction motor, the air treatment unit comprising an air treatment unit front end, an air treatment unit rear end, an air treatment unit sidewall and an air treatment chamber, the air treatment unit front end having an openable door, the air treatment chamber comprising an air treatment chamber rear end, an air treatment chamber air inlet, an air treatment chamber air outlet and a longitudinally extending axis which intersects the air treatment unit front end and the air treatment rear end, the air treatment unit comprising an assembly which includes a filter screen; and, (d) a handle provided on a sidewall of the housing, wherein the assembly is moveable relative to the air treatment unit sidewall in a common direction with the longitudinally extending axis.

12. The hand vacuum cleaner of claim 11 wherein the assembly and the sidewall are separable from each other while the openable door is in an open position.

13. The hand vacuum cleaner of claim 11 wherein the assembly and the sidewall are separable from each other while the openable door is in an open position and the openable door is attached to the sidewall.

14. The hand vacuum cleaner of claim 11 further comprising a dirt collection region that is positioned forward of the air treatment chamber.

15. The hand vacuum cleaner of claim 11 wherein the housing further comprising a second portion that is removably mounted to the first portion, the second portion defining a post-motor filter chamber which, in operation, houses a post-motor filter, wherein the longitudinally extending axis extends through the post-motor filter chamber.

16. The hand vacuum cleaner of claim 11 wherein the housing further comprising a second portion defining a post-motor filter chamber which, in operation, houses a post-motor filter, wherein the longitudinally extending axis extends through the post-motor filter chamber.

17. The hand vacuum cleaner of claim 11 wherein, when the openable door is in an open position, the dirt collection region is opened.

18. The hand vacuum cleaner of claim 11 wherein the suction motor axis of rotation and the longitudinally extending axis extend in a common direction and each axis intersects the openable door when the openable door is in the closed position.

19. The hand vacuum cleaner of claim 18 wherein the housing further comprising a second portion that is removably mounted to the first portion, the second portion defining a post-motor filter chamber which, in operation, houses a post-motor filter, wherein each of the longitudinally extending axis and the motor axis of rotation extends through the post-motor filter chamber.

20. The hand vacuum cleaner of claim 18 wherein the housing further comprising a second portion defining a post-motor filter chamber which, in operation, houses a post-motor filter, wherein each of the longitudinally extending axis and the motor axis of rotation extends through the post-motor filter chamber.

* * * * *